US009695019B1

(12) United States Patent
Huang

(10) Patent No.: US 9,695,019 B1
(45) Date of Patent: Jul. 4, 2017

(54) SUSPENSION TYPE LIFTING DEVICE

(71) Applicant: Chuan-Shan Huang, Changhua (TW)

(72) Inventor: Chuan-Shan Huang, Changhua (TW)

( * ) Notice: Subject to any disclaimer, the term of this patent is extended or adjusted under 35 U.S.C. 154(b) by 0 days.

(21) Appl. No.: 15/389,555

(22) Filed: Dec. 23, 2016

(51) Int. Cl.
*B66C 1/00* (2006.01)
*B66C 1/22* (2006.01)
*B66C 17/00* (2006.01)

(52) U.S. Cl.
CPC ..... *B66C 1/22* (2013.01); *B66C 17/00* (2013.01)

(58) Field of Classification Search
CPC .... B66C 1/22; B66C 1/18; B66C 1/16; B66C 1/24; B66C 1/62; B66C 1/34; B66C 1/12; B66C 19/002; B66C 13/00; B66C 13/04; B66C 13/40; B66C 17/00; B66F 3/00; G02B 6/4464
USPC ..... 294/67.5
See application file for complete search history.

(56) References Cited

U.S. PATENT DOCUMENTS 5,052,734 A * 10/1991 Hasegawa ..... B66C 1/663 294/81.2
7,222,902 B2 * 5/2007 Slezak ..... B66C 1/24 294/67.22
8,424,938 B1 * 4/2013 Li ..... B66C 1/10 294/67.5
2010/0176613 A1 * 7/2010 Huecker ..... B66C 1/10 294/67.5
2013/0147218 A1 * 6/2013 Steffensen ..... B66F 11/00 294/67.5

* cited by examiner

*Primary Examiner* — Stephen Vu
(74) *Attorney, Agent, or Firm* — Alan D. Kamrath; Kamrath IP Lawfirm, P.A.

(57) ABSTRACT

A suspension type lifting device includes a base unit, a bearing unit, a balance unit, a servo unit and a hanging unit. The base unit includes a first plate, a second plate and a third plate. The bearing unit includes a positioning piece and two forks. The balance unit is connected with the third plate of the base unit. The servo unit is connected with the first plate of the base unit. The hanging unit is mounted on the first plate of the base unit. When the servo unit detects that a foreign object is placed on the bearing unit, the servo unit calculates a value required for reaching a balance weight and transmits a power to drive the balance unit to swing leftward and rightward, so as to reach a balance state.

10 Claims, 8 Drawing Sheets

SUSPENSION TYPE LIFTING DEVICE

BACKGROUND OF THE INVENTION

1. Field of the Invention

The present invention relates to a mechanic device and, more particularly, to a suspension type lifting device.

2. Description of the Related Art

A forklift truck can co-operate with a pallet to transport a cargo in a horizontal manner. The forklift truck usually has a greater maneuverability in transportation of the cargo. However, the forklift truck cannot enter a narrow zone by restriction of the working place. In addition, the forklift truck needs a larger space when turning around so that the cargo frame has to correspond to movement of the forklift truck, thereby limiting usage of the space and the working place. An overhead travelling crane is used to transport a cargo in a vertical manner. The overhead travelling crane usually has a lower maneuverability in transportation of the cargo. The overhead travelling crane can enter a narrow zone without restriction of the working place. However, the overhead travelling crane cannot carry the cargo quickly and cannot stack the pallets like the overhead travelling crane. In addition, when the overhead travelling crane is used to transport frames, the worker has to push the frames to the desired position, thereby causing inconvenience to the worker. If the frames are not fixed exactly and stably, the frames easily fall down, thereby causing danger to the worker.

BRIEF SUMMARY OF THE INVENTION

The primary objective of the present invention is to provide a suspension type lifting device that co-operates a hanging arrangement to maintain the balance stability during the operation process so as to enhance the safety of transportation.

In accordance with the present invention, there is provided a suspension type lifting device comprising a base unit, a bearing unit, a balance unit, a servo unit and a hanging unit. The base unit includes a first plate, a second plate mounted on a bottom of the first plate, and a third plate connected with the second plate. The first plate is provided with at least one slot and a recess. The second plate has a substantially L-shaped profile and defines a vertical section and a horizontal section. The vertical section of the second plate has an end face provided with two longitudinal connecting portions. The horizontal section of the second plate has an end face provided with two longitudinal connecting portions. The third plate has an end face provided with two longitudinal connecting portions connected with the two longitudinal connecting portions of the horizontal section of the second plate. The third plate is provided with at least one shaft hole. The bearing unit includes a positioning piece and two forks connected with the positioning piece. The positioning piece has a rear face provided with two longitudinal connecting portions connected with the two longitudinal connecting portions of the vertical section of the second plate. The positioning piece has a front face provided with two transverse connecting portions. Each of the two forks has a substantially L-shaped profile and defines a vertical section and a horizontal section. The vertical section of each of the two forks has a rear face provided with two transverse connecting portions connected with the two transverse connecting portions of the positioning piece, to adjust a distance between the two forks. The balance unit includes at least one weight bar and at least one driven shaft. The at least one weight bar has a front end provided with two pivot ears, with the third plate of the base unit being sandwiched between the two pivot ears of the at least one weight bar. Each of the two pivot ears of the at least one weight bar is provided with a shaft hole aligning with the at least one shaft hole of the third plate. The at least one weight bar has a rear end provided with at least one recessed portion. The at least one driven shaft has a horizontal section and a vertical section. The vertical section of the at least one driven shaft extends downward from a first end of the horizontal section and extends through the shaft hole of each of the two pivot ears of the at least one weight bar and the at least one shaft hole of the third plate. The vertical section of the at least one driven shaft has a top face provided with a driven hole. The horizontal section of the at least one driven shaft rests on a top face of the at least one weight bar. The servo unit includes at least one housing inserted through the at least one slot of the first plate, at least one balance sensing apparatus mounted in the at least one housing, and at least one power output shaft protruding outward from a bottom of the at least one housing and engaging the driven hole of the at least one driven shaft. When the at least one balance sensing apparatus detects that a foreign object is placed on the bearing unit, the at least one balance sensing apparatus calculates a value required for reaching a balance weight and transmits a command signal to the at least one power output shaft which transmits a power to drive the balance unit to swing leftward and rightward, so as to reach a balance state. The hanging unit includes a hanging seat and a hanging rod. The hanging seat is secured in the recess of the first plate and is provided with a mounting hole. The hanging rod has an upper end protruding outward from the hanging seat and provided with a hanging hole. The hanging rod has a lower end provided with a universal ball movably mounted in the mounting hole of the hanging seat.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
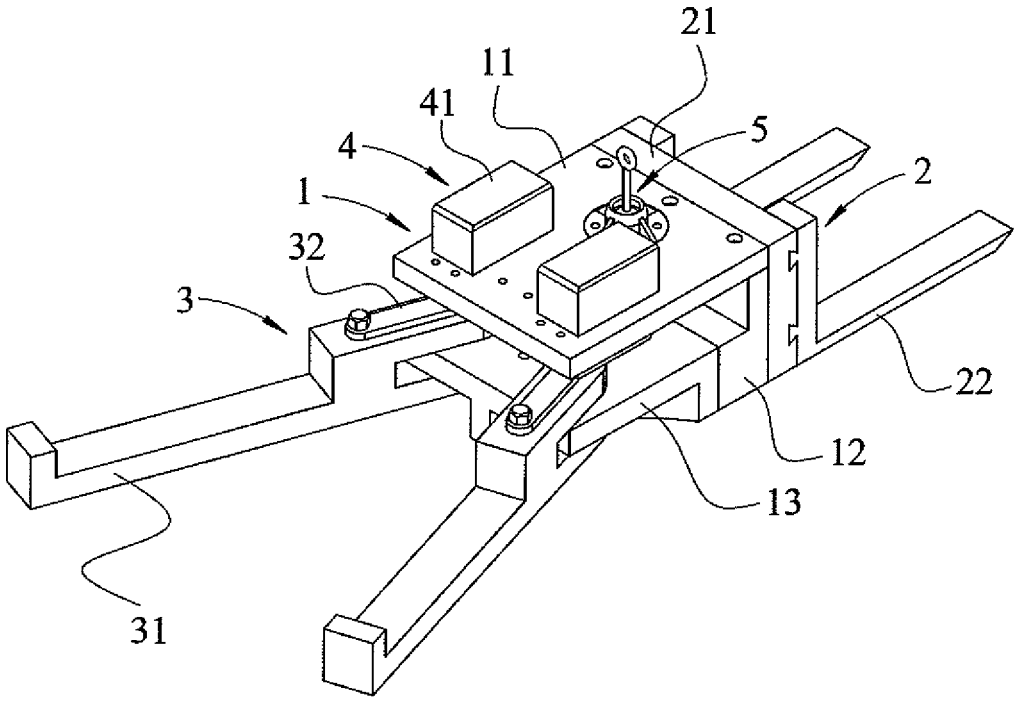
FIG. 1 is a perspective view of a suspension type lifting device in accordance with the preferred embodiment of the present invention.
Figure 2:
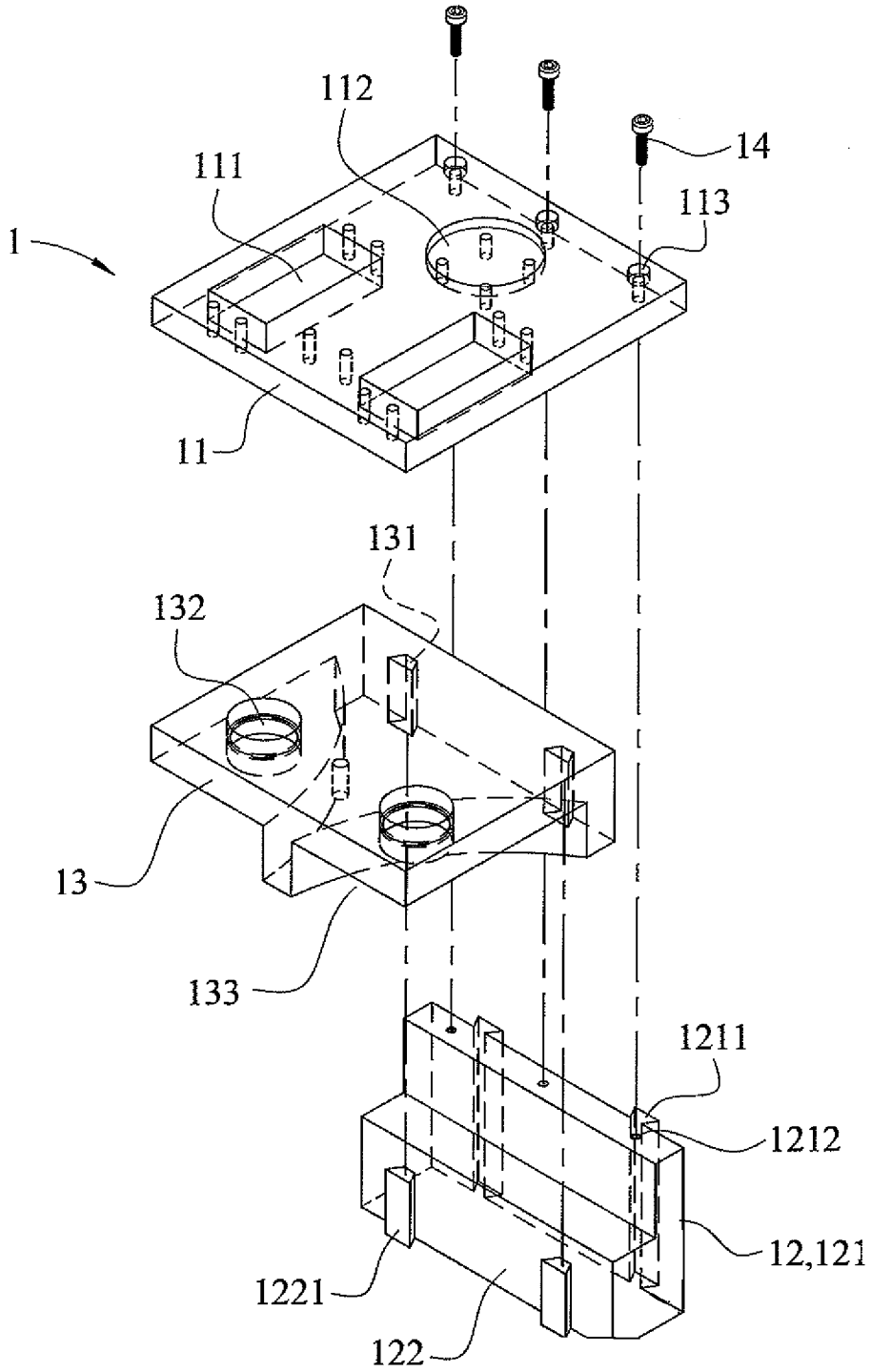
FIG. 2 is an exploded perspective view of a base unit of the suspension type lifting device as shown in FIG. 1.
Figure 3:
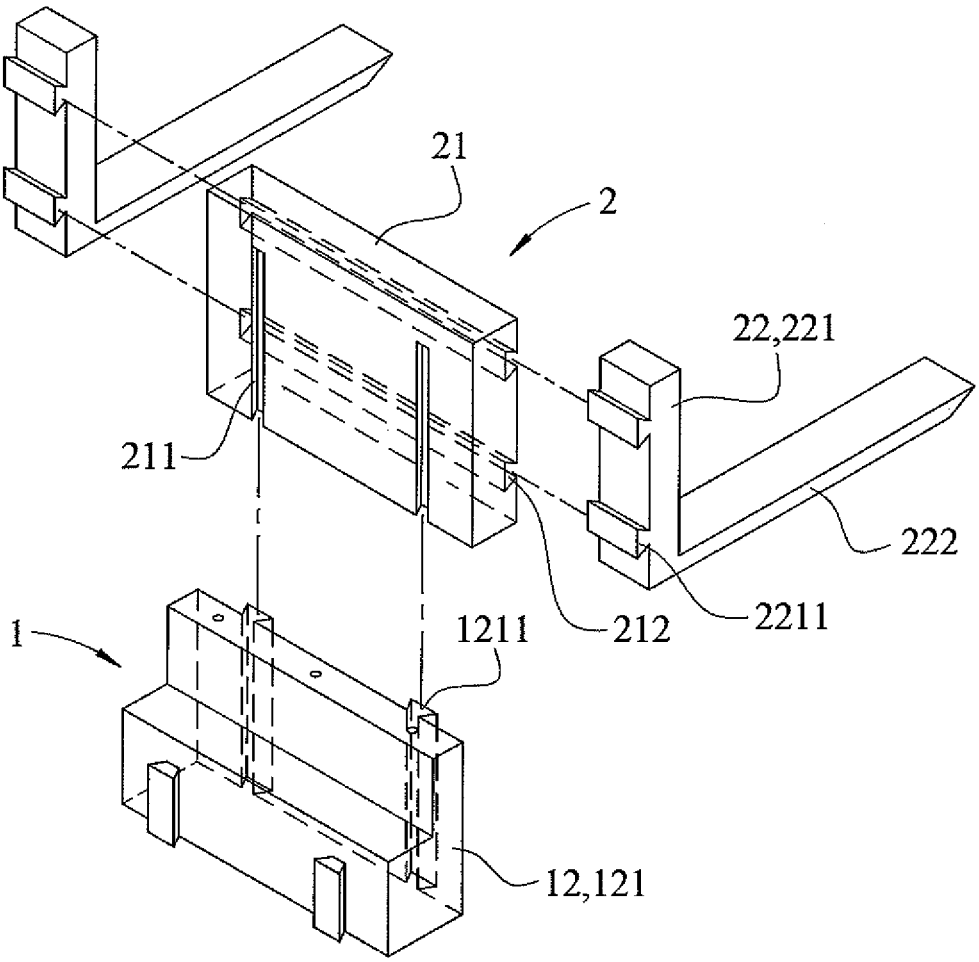
FIG. 3 is a partially exploded perspective view of the suspension type lifting device as shown in FIG. 1.
Figure 4:
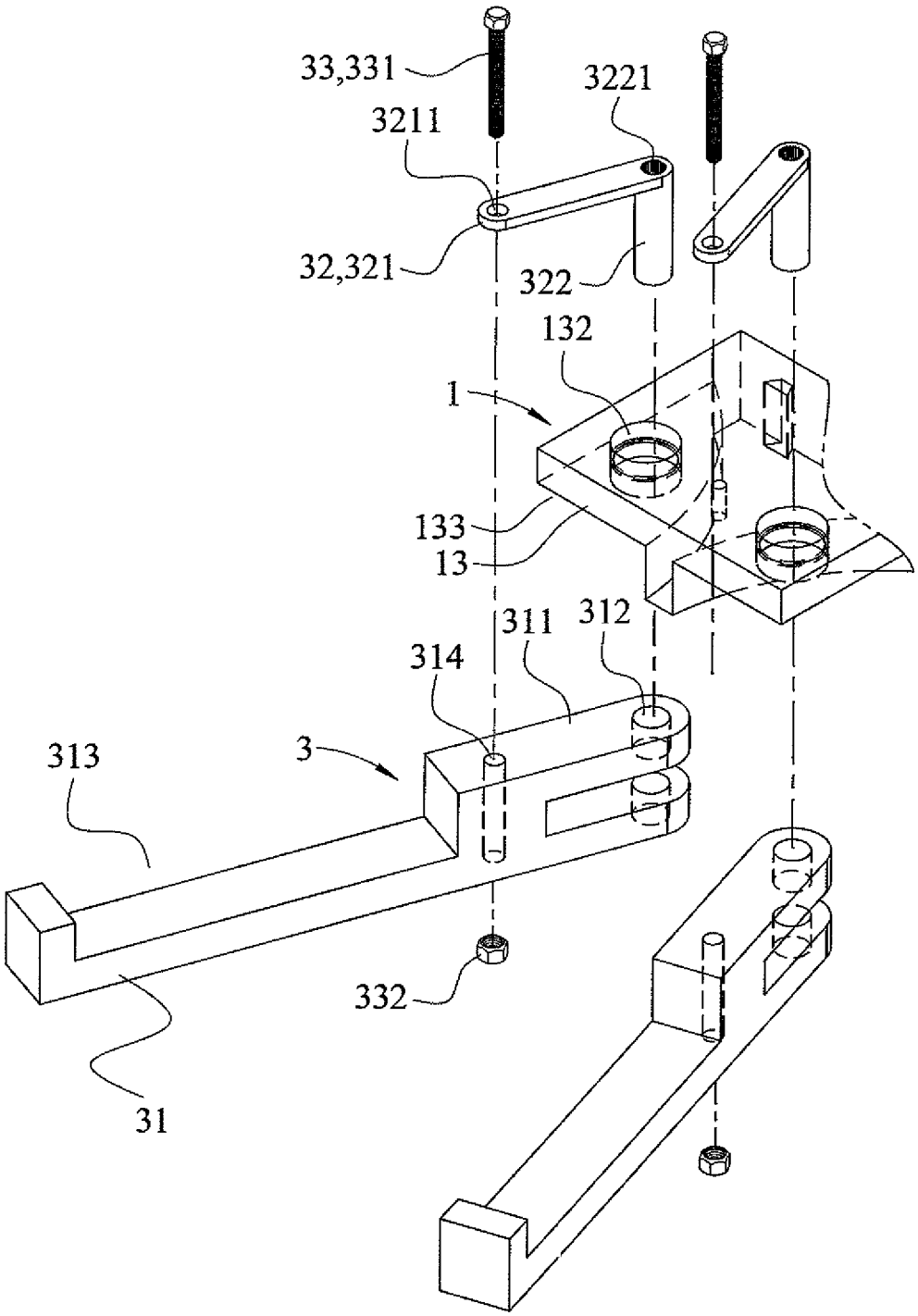
FIG. 4 is a partially exploded perspective view of the suspension type lifting device as shown in FIG. 1.
Figure 5:
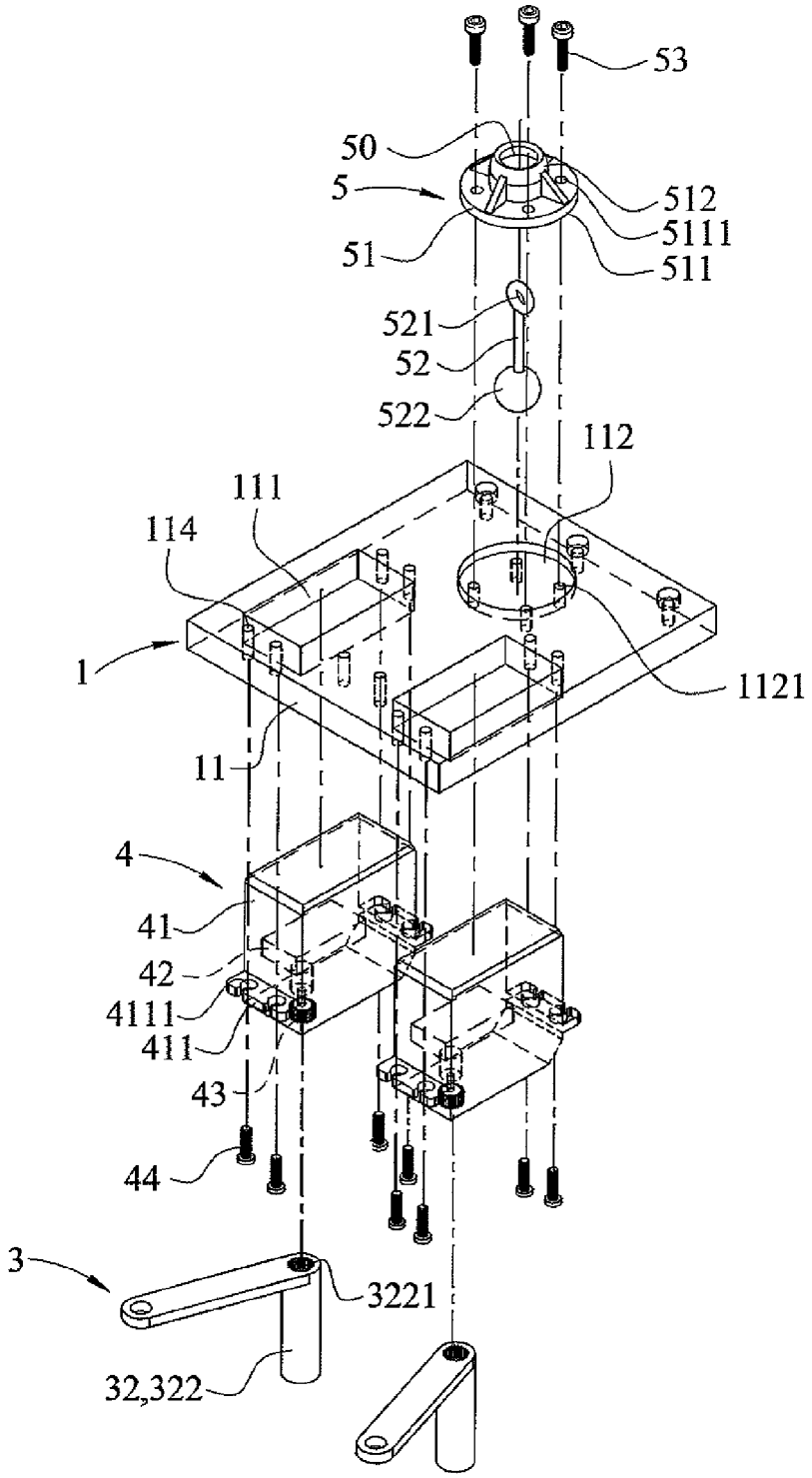
FIG. 5 is a partially exploded perspective view of the suspension type lifting device as shown in FIG. 1.

Referring to the drawings and initially to FIGS. 1-5, a suspension type lifting device in accordance with the preferred embodiment of the present invention comprises a base unit 1, a bearing unit 2, a balance unit 3, a servo unit 4 and a hanging unit 5.

The base unit 1 includes a first plate 11, a second plate 12 mounted on a bottom of the first plate 11, and a third plate 13 connected with the second plate 12. The first plate 11 is made of metallic material, such as a steel or iron. The first plate 11 is provided with at least one slot 111 and a recess 112. The slot 111 of the first plate 11 extends longitudinally through the first plate 11. The second plate 12 is made of metallic material, such as a steel or iron. The second plate 12 has a substantially L-shaped profile and defines a vertical section 121 and a horizontal section 122. The vertical section 121 of the second plate 12 has an end face provided with two longitudinal connecting portions 1211. The horizontal section 122 of the second plate 12 has an end face provided with two longitudinal connecting portions 1221. The third plate 13 is made of metallic material, such as a steel or iron. The third plate 13 has an end face provided with two longitudinal connecting portions 131 connected with the two longitudinal connecting portions 1221 of the horizontal section 122 of the second plate 12. The third plate 13 is provided with at least one shaft hole 132 which extends longitudinally through the third plate 13.

The bearing unit 2 includes a positioning piece 21 and two forks 22 connected with the positioning piece 21. The positioning piece 21 is made of metallic material, such as a steel or iron. The positioning piece 21 has a rear face provided with two longitudinal connecting portions 211 connected with the two longitudinal connecting portions 1211 of the vertical section 121 of the second plate 12 to secure the positioning piece 21 of the bearing unit 2 to a front end of the second plate 12 of the base unit 1. The positioning piece 21 has a front face provided with two transverse connecting portions 212. Each of the two forks 22 is made of metallic material, such as a steel or iron. Each of the two forks 22 has a substantially L-shaped profile and defines a vertical section 221 and a horizontal section 222. The vertical section 221 of each of the two forks 22 has a rear face provided with two transverse connecting portions 2211 connected with the two transverse connecting portions 212 of the positioning piece 21 to mount the two forks 22 to the front face of the positioning piece 21, and to adjust a distance between the two forks 22.

The balance unit 3 includes at least one weight bar 31 and at least one driven shaft 32. The at least one weight bar 31 is made of metallic material, such as a steel or iron. The at least one weight bar 31 has a front end provided with two pivot ears 311, with the third plate 13 of the base unit 1 being sandwiched between the two pivot ears 311 of the at least one weight bar 31. Each of the two pivot ears 311 of the at least one weight bar 31 is provided with a shaft hole 312 aligning with the at least one shaft hole 132 of the third plate 13. The at least one weight bar 31 has a rear end provided with at least one recessed portion 313. The at least one driven shaft 32 is made of metallic material, such as a steel or iron. The at least one driven shaft 32 has a horizontal section 321 and a vertical section 322. The vertical section 322 of the at least one driven shaft 32 extends downward from a first end of the horizontal section 321 and extends through the shaft hole 312 of each of the two pivot ears 311 of the at least one weight bar 31 and the at least one shaft hole 132 of the third plate 13, to connect the at least one weight bar 31 of the balance unit 3 with the third plate 13 of the base unit 1, so that the balance unit 3 is connected with the base unit 1. The vertical section 322 of the at least one driven shaft 32 has a top face provided with a driven hole 3221. The horizontal section 321 of the at least one driven shaft 32 rests on a top face of the at least one weight bar 31.

The servo unit 4 includes at least one housing 41 inserted through the at least one slot 111 of the first plate 11, at least one balance sensing apparatus 42 mounted in the at least one housing 41, and at least one power output shaft 43 protruding outward from a bottom of the at least one housing 41 and engaging the driven hole 3221 of the at least one driven shaft 32. When the at least one balance sensing apparatus 42 detects that a foreign object is placed on the bearing unit 2, the at least one balance sensing apparatus 42 calculates a value required for reaching a balance weight and transmits a command signal to the at least one power output shaft 43 which transmits a power to drive the balance unit 3 to swing leftward and rightward, so as to reach a balance state.

The hanging unit 5 includes a hanging seat 51 and a hanging rod 52. The hanging seat 51 is secured in the recess 112 of the first plate 11 and is provided with a mounting hole 50 which extends longitudinally through the hanging seat 51. The hanging rod 52 has an upper end protruding outward from the hanging seat 51 and provided with a hanging hole 521. The hanging rod 52 has a lower end provided with a universal ball 522 movably mounted in the mounting hole 50 of the hanging seat 51 so that the hanging rod 52 has an angle adjustable function.

In the preferred embodiment of the present invention, each of the two longitudinal connecting portions 1221 of the horizontal section 122 of the second plate 12 is a dovetailed projection or groove, and each of the two longitudinal connecting portions 131 of the third plate 13 is a dovetailed projection or groove, so that the second plate 12 and the third plate 13 are connected in a sliding manner. Preferably, each of the two longitudinal connecting portions 1221 of the horizontal section 122 of the second plate 12 is a dovetailed projection, and each of the two longitudinal connecting portions 131 of the third plate 13 is a dovetailed groove.

In the preferred embodiment of the present invention, each of the two longitudinal connecting portions 1211 of the vertical section 121 of the second plate 12 is a dovetailed projection or groove, and each of the two longitudinal connecting portions 211 of the positioning piece 21 is a dovetailed projection or groove, so that the second plate 12 of the base unit 1 and the positioning piece 21 of the bearing unit 2 are connected in a sliding manner. Preferably, each of the two longitudinal connecting portions 1211 of the vertical section 121 of the second plate 12 is a dovetailed projection, and each of the two longitudinal connecting portions 211 of the positioning piece 21 is a dovetailed groove.

In the preferred embodiment of the present invention, the first plate 11 is provided with a plurality of stepped holes 113, the vertical section 121 of the second plate 12 has a top face provided with a plurality of screw holes 1212, and the base unit 1 further includes a plurality of fastening members 14 extending through the stepped holes 113 of the first plate 11 and screwed into the screw holes 1212 of the second plate 12 to secure the second plate 12 to the first plate 11.

In the preferred embodiment of the present invention, the at least one weight bar 31 and the at least one driven shaft 32 of the balance unit 3 have the same number, and the balance unit 3 preferably includes two weight bars 31 and two driven shafts 32. In addition, the third plate 13 of the base unit 1 has a bottom provided with at least one recessed zone 133 for receiving one of the two pivot ears 311 of the at least one weight bar 31. Preferably, the third plate 13 of the base unit 1 is provided with two recessed zones 133.

In the preferred embodiment of the present invention, the front end of the at least one weight bar 31 is provided with a through hole 314, the horizontal section 321 of the at least one driven shaft 32 has a second end provided with a through hole 3211, and the balance unit 3 further includes at least one connecting module 33 extending through the through hole 3211 of the horizontal section 321 of the at least one driven shaft 32 and the through hole 314 of the at least one weight bar 31 to connect the at least one driven shaft 32 with the at least one weight bar 31. Preferably, the at least one connecting module 33 includes a bolt 331 extending through the through hole 3211 of the horizontal section 321 of the at least one driven shaft 32 and the through hole 314 of the at least one weight bar 31, and a nut 332 screwed onto the bolt 331.

In the preferred embodiment of the present invention, the at least one housing 41, the at least one balance sensing apparatus 42, and the at least one power output shaft 43 of the servo unit 4 have the same number, and the servo unit 4 preferably includes two housings 41, two balance sensing apparatuses 42, and two power output shafts 43.

In the preferred embodiment of the present invention, the at least one power output shaft 43 of the servo unit 4 is in the form of a gear, and the driven hole 3221 of the at least one driven shaft 32 of the balance unit 3 has a peripheral wall in the form of a gear face, so that the balance unit 3 engages the servo unit 4.

In the preferred embodiment of the present invention, the at least one housing 41 of the servo unit 4 has two opposite ends each formed with a resting protrusion 411 resting on a bottom of the first plate 11. The resting protrusion 411 of the at least one housing 41 is provided with a plurality of through holes 4111, the first plate 11 of the base unit 1 is provided with a plurality of screw holes 114, and the servo unit 4 further includes a plurality of fastening members 44 extending through the through holes 4111 of the respective resting protrusion 411 of the at least one housing 41 and screwed into the screw holes 114 of the first plate 11 to connect the at least one housing 41 of the servo unit 4 with the first plate 11 of the base unit 1. The screw holes 114 of the first plate 11 are arranged on a periphery of the at least one slot 111.

In the preferred embodiment of the present invention, the hanging seat 51 of the hanging unit 5 includes a stand 511 mounted in the recess 112 of the first plate 11, and a limit flange 512 extending upward from a top face of the stand 511. The stand 511 of the hanging seat 51 is provided with a plurality of through holes 5111, the recess 112 of the first plate 11 is provided with a plurality of screw holes 1121, and the hanging unit 5 further includes a plurality of fastening members 53 extending through the through holes 5111 of the hanging seat 51 and screwed into the screw holes 1121 of the first plate 11 to connect the hanging seat 51 of the hanging unit 5 with the first plate 11 of the base unit 1. The mounting hole 50 of the hanging seat 51 extends through the stand 511 and the limit flange 512.

In the preferred embodiment of the present invention, the first plate 11, the second plate 12 and the third plate 13 of the base unit 1 are formed integrally.

Figure 6:
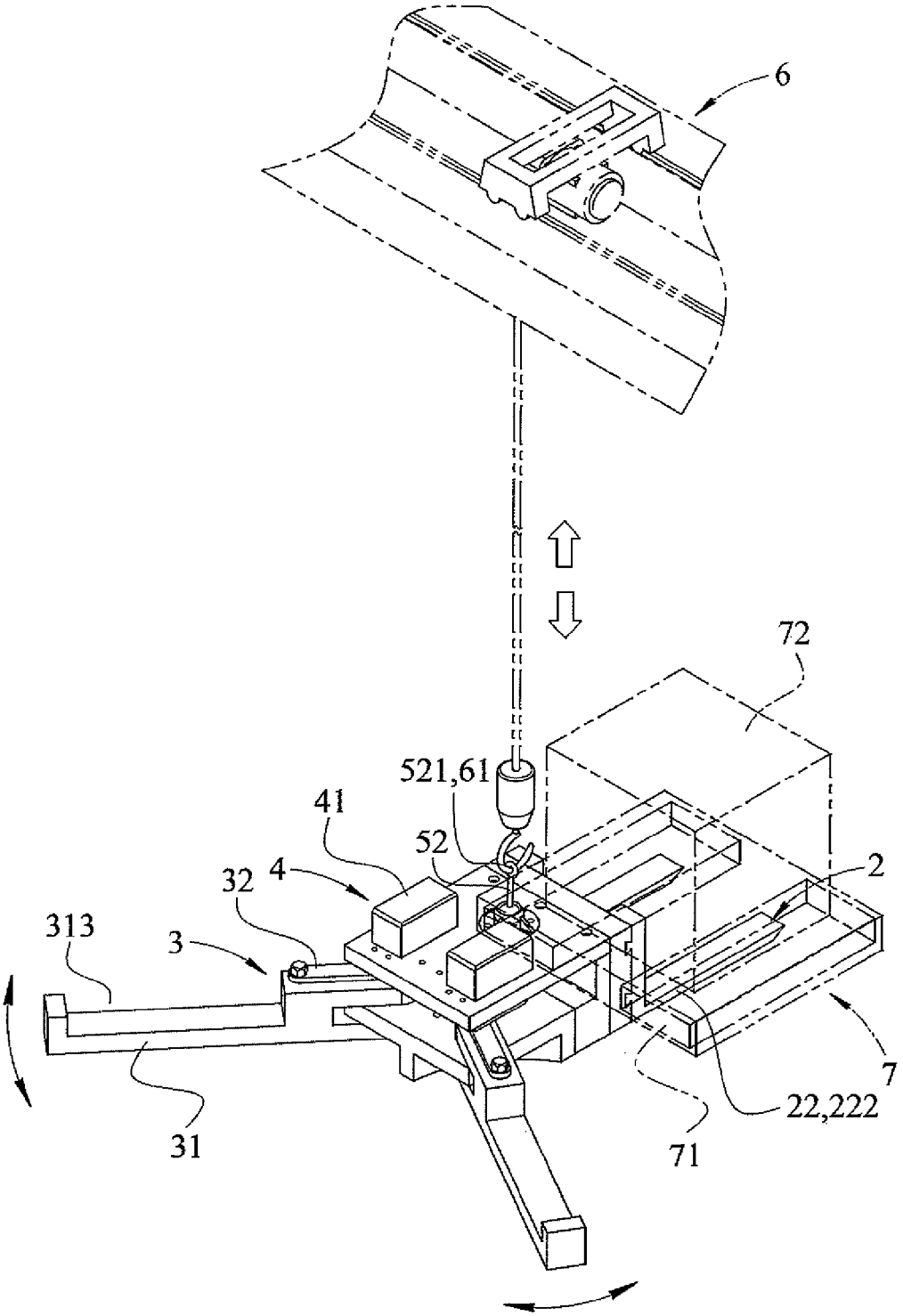
FIG. 6 is a schematic perspective operational view of the suspension type lifting device as shown in FIG. 1 in use.
Figure 7:
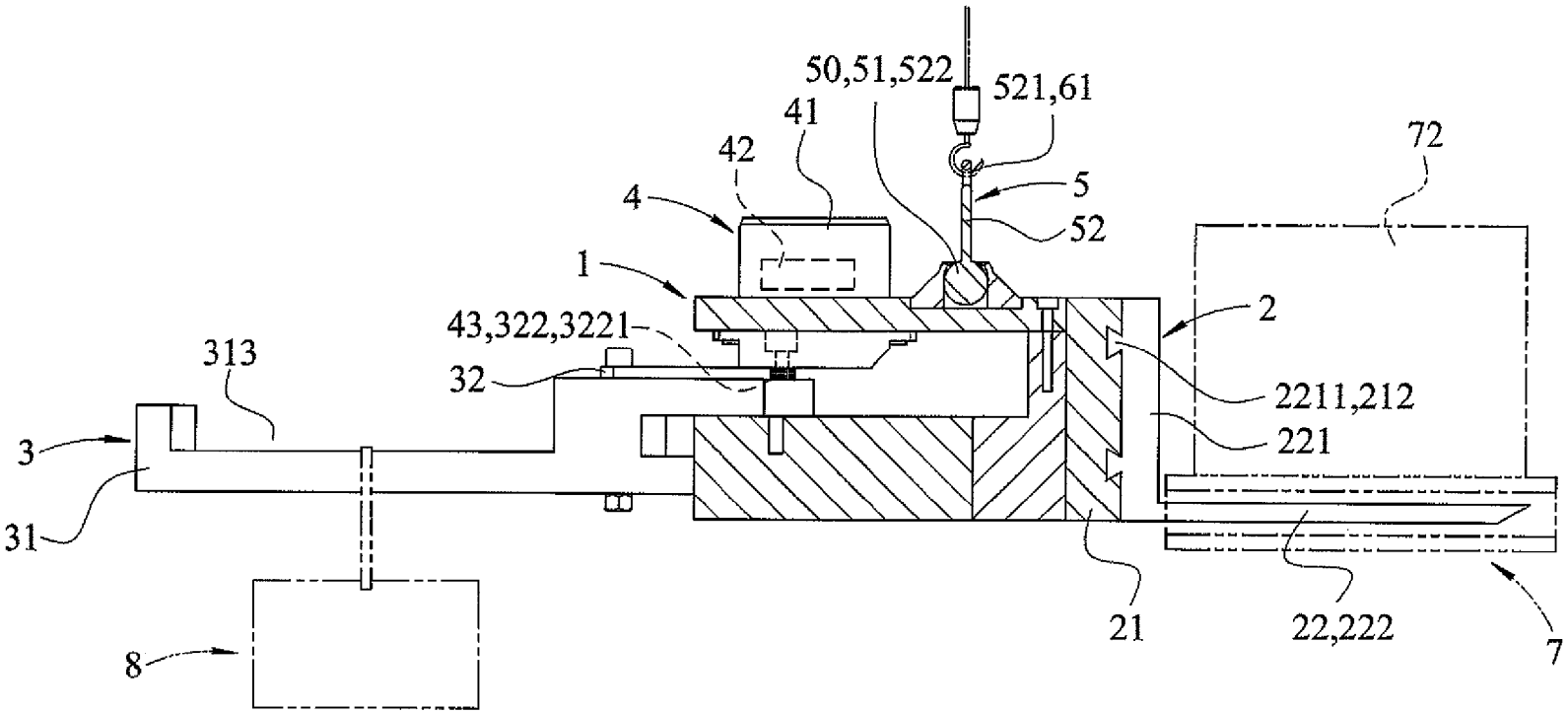
FIG. 7 is a schematic cross-sectional operational view of the suspension type lifting device as shown in FIG. 1 in use.
Figure 8:
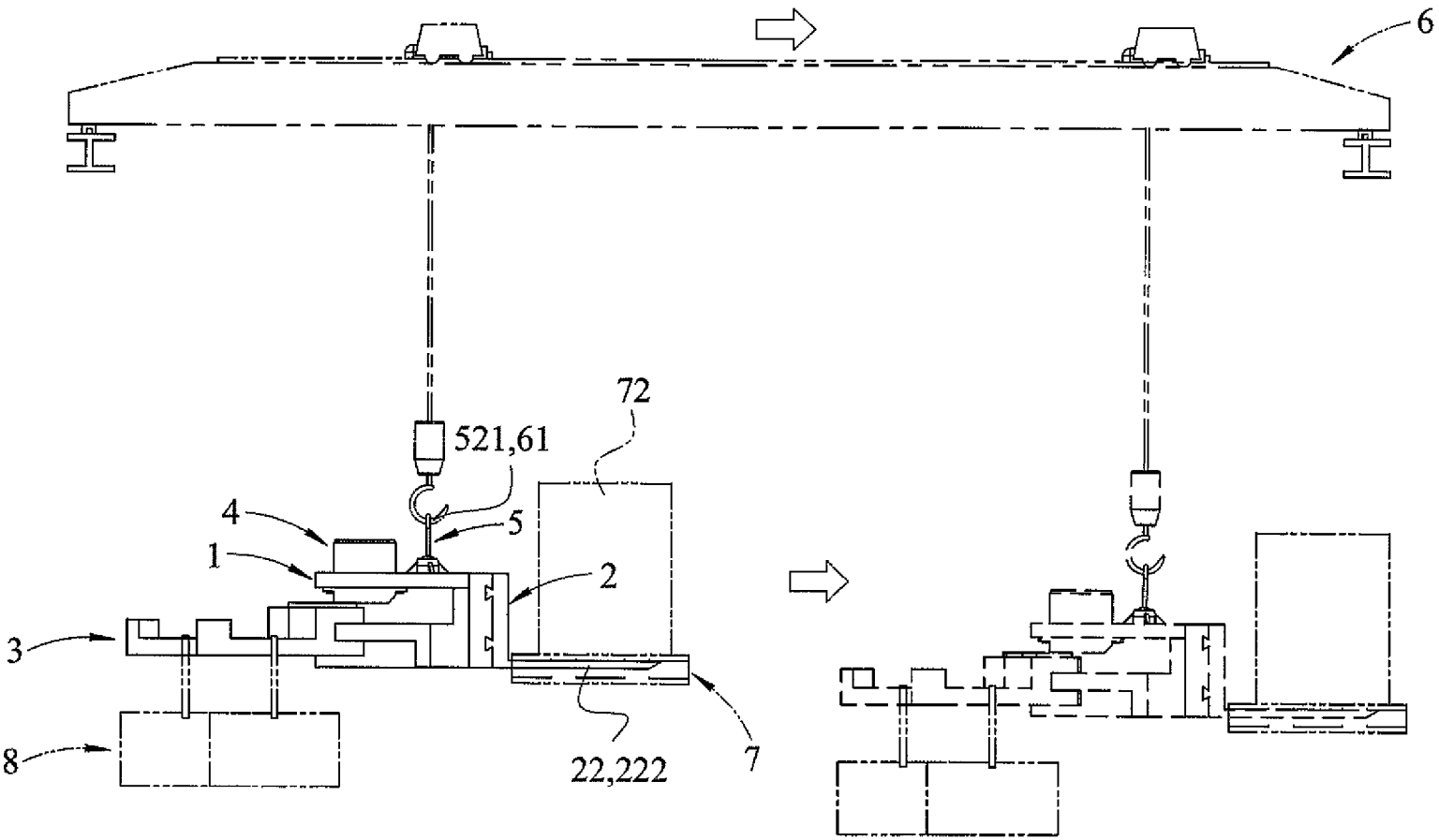
FIG. 8 is a schematic front operational view of the suspension type lifting device as shown in FIG. 1 in use.

In operation, referring to FIGS. 6-8 with reference to FIGS. 1-5, the lifting device of the present invention co-operates a hanging arrangement 6, such as an overhead travelling crane, to carry and move a cargo 72. The hanging arrangement 6 includes a hanger 61 hooked on the hanging hole 521 of the hanging rod 52 of the hanging unit 5. The horizontal section 222 of each of the two forks 22 of the bearing unit 2 is inserted into an entry 71 of a pallet 7 which carries the cargo 72. At this time, the two transverse connecting portions 2211 of the vertical section 221 of each of the two forks 22 are slidable relative to the two transverse connecting portions 212 of the positioning piece 21, so that the two forks 22 are movable relative to the positioning piece 21 to adjust the distance between the two forks 22 to facilitate the two forks 22 being inserted into the entries 71 of the pallet 7. When the hanging rod 52 of the hanging unit 5 is lifted by the hanger 61 of the hanging arrangement 6, the at least one balance sensing apparatus 42 of the servo unit 4 detects that the cargo 72 is placed on the pallet 7 and the bearing unit 2 and calculates the weight (the maximum weight reaches 900 kilograms) of the cargo 72 applied on the bearing unit 2. At the same time, the at least one balance sensing apparatus 42 calculates a value required for reaching a balance weight and transmits a command signal to the at least one power output shaft 43 which transmits a power to drive the at least one weight bar 31 of the balance unit 3 to swing leftward and rightward as shown in FIG. 6, so as to reach a balance state. Preferably, the at least one balance sensing apparatus 42 calculates the weight by 250 times per second. Preferably, at least one counterweight 8 is hung on the at least one recessed portion 313 of the at least one weight bar 31 to balance the weight of the cargo 72 so as to reach a balance state, thereby preventing from incurring sway or deflection. At this time, the universal ball 522 of the hanging rod 52 is rotatable in the mounting hole 50 of the hanging seat 51 to provide an angle adjustable function, so that the user can push the base unit 1 to change the angle of the base unit 1. When the base unit 1 is adjusted to the required angle and direction and is delivered to a determined position as shown in FIG. 8, the base unit 1 is lowered slowly to accomplish the transportation procedure.

Accordingly, the lifting device of the present invention co-operates the hanging arrangement 6 to maintain the balance stability during the operation process so as to enhance the safety of transportation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A suspension lifting device comprising:

a base unit, a bearing unit, a balance unit, a servo unit and a hanging unit;

wherein:

the base unit includes a first plate, a second plate mounted on a bottom of the first plate, and a third plate connected with the second plate;

the first plate is provided with at least one slot and a recess;

the second plate has a substantially L-shaped profile and defines a vertical section and a horizontal section;

the vertical section of the second plate has an end face provided with two longitudinal connecting portions;

the horizontal section of the second plate has an end face provided with two longitudinal connecting portions;

the third plate has an end face provided with two longitudinal connecting portions connected with the two longitudinal connecting portions of the horizontal section of the second plate;

the third plate is provided with at least one shaft hole;

the bearing unit includes a positioning piece and two forks connected with the positioning piece;

the positioning piece has a rear face provided with two longitudinal connecting portions connected with the two longitudinal connecting portions of the vertical section of the second plate;

the positioning piece has a front face provided with two transverse connecting portions;

each of the two forks has a substantially L-shaped profile and defines a vertical section and a horizontal section;

the vertical section of each of the two forks has a rear face provided with two transverse connecting portions connected with the two transverse connecting portions of the positioning piece, to adjust a distance between the two forks;

the balance unit includes at least one weight bar and at least one driven shaft;

the at least one weight bar has a front end provided with two pivot ears, with the third plate of the base unit being sandwiched between the two pivot ears of the at least one weight bar;

each of the two pivot ears of the at least one weight bar is provided with a shaft hole aligning with the at least one shaft hole of the third plate;

the at least one weight bar has a rear end provided with at least one recessed portion;

the at least one driven shaft has a horizontal section and a vertical section;

the vertical section of the at least one driven shaft extends downward from a first end of the horizontal section and extends through the shaft hole of each of the two pivot ears of the at least one weight bar and the at least one shaft hole of the third plate;

the vertical section of the at least one driven shaft has a top face provided with a driven hole;

the horizontal section of the at least one driven shaft rests on a top face of the at least one weight bar;

the servo unit includes at least one housing inserted through the at least one slot of the first plate, at least one balance sensing apparatus mounted in the at least one housing, and at least one power output shaft protruding outward from a bottom of the at least one housing and engaging the driven hole of the at least one driven shaft;

when the at least one balance sensing apparatus detects that a foreign object is placed on the bearing unit, the at least one balance sensing apparatus calculates a value required for reaching a balance weight and transmits a command signal to the at least one power output shaft which transmits a power to drive the balance unit to swing leftward and rightward, so as to reach a balance state;

the hanging unit includes a hanging seat and a hanging rod;

the hanging seat is secured in the recess of the first plate and is provided with a mounting hole;

the hanging rod has an upper end protruding outward from the hanging seat and provided with a hanging hole; and the hanging rod has a lower end provided with a universal ball movably mounted in the mounting hole of the hanging seat.

2. The suspension lifting device of claim 1, wherein each of the two longitudinal connecting portions of the horizontal section of the second plate is a dovetailed projection or groove, and each of the two longitudinal connecting portions of the third plate is a dovetailed projection or groove, so that the second plate and the third plate are connected in a sliding manner.

3. The suspension lifting device of claim 1, wherein each of the two longitudinal connecting portions of the vertical section of the second plate is a dovetailed projection or groove, and each of the two longitudinal connecting portions of the positioning piece is a dovetailed projection or groove, so that the second plate of the base unit and the positioning piece of the bearing unit are connected in a sliding manner.

4. The suspension lifting device of claim 1, wherein the first plate is provided with a plurality of stepped holes, the vertical section of the second plate has a top face provided with a plurality of screw holes, and the base unit further includes a plurality of fastening members extending through the stepped holes of the first plate and screwed into the screw holes of the second plate.

5. The suspension lifting device of claim 1, wherein the at least one weight bar and the at least one driven shaft of the balance unit have the same number, and the balance unit preferably includes two weight bars and two driven shafts.

6. The suspension lifting device of claim 1, wherein the front end of the at least one weight bar is provided with a through hole, the horizontal section of the at least one driven shaft has a second end provided with a through hole, and the balance unit further includes at least one connecting module extending through the through hole of the horizontal section of the at least one driven shaft and the through hole of the at least one weight bar.

7. The suspension lifting device of claim 1, wherein the at least one housing, the at least one balance sensing apparatus, and the at least one power output shaft of the servo unit have the same number, and the servo unit preferably includes two housings, two balance sensing apparatuses and two power output shafts.

8. The suspension lifting device of claim 1, wherein the at least one power output shaft of the servo unit is in the form of a gear, and the driven hole of the at least one driven shaft of the balance unit has a peripheral wall in the form of a gear face, so that the balance unit engages the servo unit.

9. The suspension lifting device of claim 1, wherein:

the at least one housing of the servo unit has two opposite ends each formed with a resting protrusion resting on a bottom of the first plate;

the resting protrusion of the at least one housing is provided with a plurality of through holes;

the first plate of the base unit is provided with a plurality of screw holes; and the servo unit further includes a plurality of fastening members extending through the through holes of the respective resting protrusion of the at least one housing and screwed into the screw holes of the first plate.

10. The suspension lifting device of claim 1, wherein:

the hanging seat of the hanging unit includes a stand mounted in the recess of the first plate, and a limit flange extending upward from a top face of the stand;

the stand of the hanging seat is provided with a plurality of through holes;

the recess of the first plate is provided with a plurality of screw holes;

the hanging unit further includes a plurality of fastening members extending through the through holes of the hanging seat and screwed into the screw holes of the first plate; and the mounting hole of the hanging seat extends through the stand and the limit flange.

* * * * *